US011209241B2

(12) United States Patent
Pellegrini

(10) Patent No.: US 11,209,241 B2
(45) Date of Patent: Dec. 28, 2021

(54) HANDGUN HOLSTER HAVING A THUMB-OPERATED SAFETY LOCK ON THE SPENT CASING EJECTION PORT OF THE HANDGUN

(71) Applicant: RADAR LEATHER DIVISION S.R.L., Fucecchio (IT)

(72) Inventor: Pietro Pellegrini, Fucecchio (IT)

(73) Assignee: RADAR LEATHER DIVISION S.R.L., Fucecchio (IT)

( * ) Notice: Subject to any disclaimer, the term of this patent is extended or adjusted under 35 U.S.C. 154(b) by 0 days.

(21) Appl. No.: 16/976,144

(22) PCT Filed: Mar. 4, 2019

(86) PCT No.: PCT/IB2019/051716
§ 371 (c)(1),
(2) Date: Aug. 27, 2020

(87) PCT Pub. No.: WO2019/171241
PCT Pub. Date: Sep. 12, 2019

(65) Prior Publication Data

US 2020/0408488 A1 Dec. 31, 2020

(30) Foreign Application Priority Data

Mar. 6, 2018 (IT) ..... 102018000003306

(51) Int. Cl.
*F41C 33/02* (2006.01)

(52) U.S. Cl.
CPC ..... *F41C 33/0263* (2013.01)

(58) Field of Classification Search
CPC ..... F41C 33/0263; F41C 33/0272
See application file for complete search history.

(56) References Cited

U.S. PATENT DOCUMENTS

| | | | | |
|---|---|---|---|---|
| 10,473,427 | B1 * | 11/2019 | Sereday | F41C 33/0263 |
| 2006/0157520 | A1 | 7/2006 | Clifton, Jr. | |
| 2006/0180620 | A1 | 8/2006 | Senn et al. | |
| 2007/0181619 | A1 * | 8/2007 | Seyfert | F41C 33/04 224/196 |

(Continued)

FOREIGN PATENT DOCUMENTS

| | | | |
|---|---|---|---|
| EP | 2707671 | B1 | 7/2017 |
| WO | 2007092008 | A2 | 8/2007 |

(Continued)

OTHER PUBLICATIONS

International Search Report and Written Opinion for Corresponding International Application No. PCT/IB2019/051716 (11 Pages) (dated Apr. 16, 2019).

*Primary Examiner* — Derek J Battisti
(74) *Attorney, Agent, or Firm* — Lucas & Mercanti, LLP

(57) ABSTRACT

The present invention relates to the field of safety devices for weapons and, more specifically, it relates to a holster for handguns (P) provided with ejection port (PI) for spent casings, provided with a locking device to prevent the accidental or unauthorized extraction of the handgun from the holster itself, of the type engaging with the aforesaid ejection port, which can be actuated in an improved manner making use of the thumb of the hand that grips the weapon.

14 Claims, 2 Drawing Sheets

(56) References Cited

U.S. PATENT DOCUMENTS

| | | | | |
|---|---|---|---|---|
| 2011/0101063 | A1* | 5/2011 | Zusman | F41C 33/0254 224/682 |
| 2011/0174849 | A1 | 7/2011 | Clifton, Jr. | |
| 2013/0075435 | A1* | 3/2013 | Hellweg | F41C 33/0227 224/243 |
| 2014/0048572 | A1* | 2/2014 | Yeates | F41C 33/0272 224/193 |
| 2014/0048573 | A1* | 2/2014 | Pellegrini | F41C 33/0227 224/243 |

FOREIGN PATENT DOCUMENTS

| | | | |
|---|---|---|---|
| WO | 2012153278 | A1 | 11/2012 |
| WO | 2012153279 | A1 | 11/2012 |

* cited by examiner

HANDGUN HOLSTER HAVING A THUMB-OPERATED SAFETY LOCK ON THE SPENT CASING EJECTION PORT OF THE HANDGUN

CROSS-REFERENCE TO RELATED APPLICATIONS

This application is a 371 of PCT/IB2019/051716, filed Mar. 4, 2019, which claims the benefit of Italian Patent Application No. 102018000003306 filed Mar. 6, 2018, the contents of each of which are incorporated herein by reference.

FIELD OF THE INVENTION

The present invention relates to the field of safety devices for weapons and, more specifically, it relates to a holster for handguns provided with ejection port for spent bullet casings, provided with a locking device to prevent the accidental or unauthorised extraction of the handgun from the holster itself, of the type engaging with the aforesaid ejection port, which can be actuated in an improved manner making use of the thumb of the hand that grips the weapon.

STATE OF THE ART

As is well known, holsters for handguns, in particular those in use by police and personnel assigned to safeguard persons and property, have to be so shaped as to hold the weapon securely, not only during the normal movements of the user, but also on the occasion of more intense physical activities, scuffles and the like, while allowing the weapon to be easily and quickly extracted by the user in case of need.

There are numerous safety devices that lock the weapon inside the shell body of the holster when it is not used, then releasing it more or less quickly when necessary. While on one hand these safety devices must secure the weapon effectively to the holster when not in use, on the other hand they must assure an easy and quick extraction of the handgun at the appropriate time.

In some known devices, the "ejection port" is exploited, i.e. the milling or recess from which spent bullet casings are ejected, as a seat in which to engage an element that locks the handgun inside the holster. The lock must clearly be removable, to allow extraction of the handgun, by effect of an actuation by the hand that grips (or is intended to grip) the weapon.

Among them, an appreciated solution is the one according to which the unlocking or releasing actuation takes place using the thumb of the hand, to act concurrently while the hand grabs the handgun grip, and pushing indeed with the thumb to move a release element with respect to the body of the holster, on a plane substantially parallel to a side wall of the body itself and in a direction towards the front and/or lower region of the holster. The spatial reference is here made to corresponding directions defined by the weapon in shooting orientation, with the barrel substantially horizontal, so that the lower part of the holster is the one that corresponds to the region of the trigger of the weapon, while the front (or anterior) part is the holster bottom end region, where the muzzle of the barrel becomes positioned. The above described release actuation mode is indeed natural and fluid with respect to the motion required to grab the weapon, allowing in particular the palm of the hand to come in contact with the handgun handle.

A system that generically makes use of this operating concept is disclosed in European patent EP2707671 in the name of the same applicant, making use of a pushbutton slidable along and close to the top wall or ridge of the body of the holster. International patent application WO2007/092008 also describes a locking lever which extends in the cavity of the holster, in the longitudinal direction and along the top wall or ridge of the holster. The lever has a locking element, positioned in a front area, adapted to engage with the ejection port of the weapon, and a rear actuation end that, when pushed by the thumb with a direction of actuation that has forwards and downwards components, elastically deforms the lever so as to disengage the locking element from the ejection port, allowing the extraction of the weapon. The same elastic deformation passively assists the reinsertion of the weapon into the holster. The system is completed by an additional element, a tension regulator, mounted inside the holster to position the handgun correctly with respect to the locking lever, and in particular to assure a mechanical contrast that prevents undesired play between the locking element and the handgun, keeping them stably pushed against each other to reliably exercise the required stopping action.

In this system just described, a single member performs the locking and releasing functions, and the disengagement movement is, as mentioned, a consequence of a deformation of the lever (which, by the way, cannot exceed a certain elongation, limited by its shape and by the way it is fixed on the holster body), made of polymeric material. However, variations in environmental conditions (temperature, humidity) can change the elastic behaviour of the material, leading to significant malfunctioning. The additional tension regulator element, necessary for the correct operation of the lever, also determines a structural and production complication. Furthermore, the position and conformation of the actuating end on the lateral side of the holster body and near the top ridge wall thereof, causes the unlocking/release action not to be always easy, because the thumb must to some extent reach for the point on which pressure is to be exerted. This drawback, in addition to hindering contact of the palm of the hand with the back of the grip of the handgun, may be further enhanced depending on the anatomical conformation of the individual user.

SUMMARY OF THE INVENTION

The object of the present invention is to provide a safety device for holsters of handguns with ejection port for spent casings, with thumb-actuated unlocking, which uses an alternative system with respect to known ones, so that it offers better prerogatives in terms of reliable efficiency, convenience of use, without sacrificing structural simplicity and production economy.

This and other objects are achieved with a holster with thumb-operated lock on the spent casing ejection port of the handgun, the essential features of which are defined by the first of the attached claims.

Additional important features of the present improved holster are set forth in the dependent claims.

BRIEF DESCRIPTION OF THE DRAWINGS

Characteristics and advantages of the holster with thumb-operated lock on the spent casing ejection port of the handgun according to the present invention will become apparent from the following description of an embodiment thereof, provided by way of non-limiting example, with reference to the accompanying drawings wherein.

DETAILED DESCRIPTION OF THE INVENTION

Figure 1:
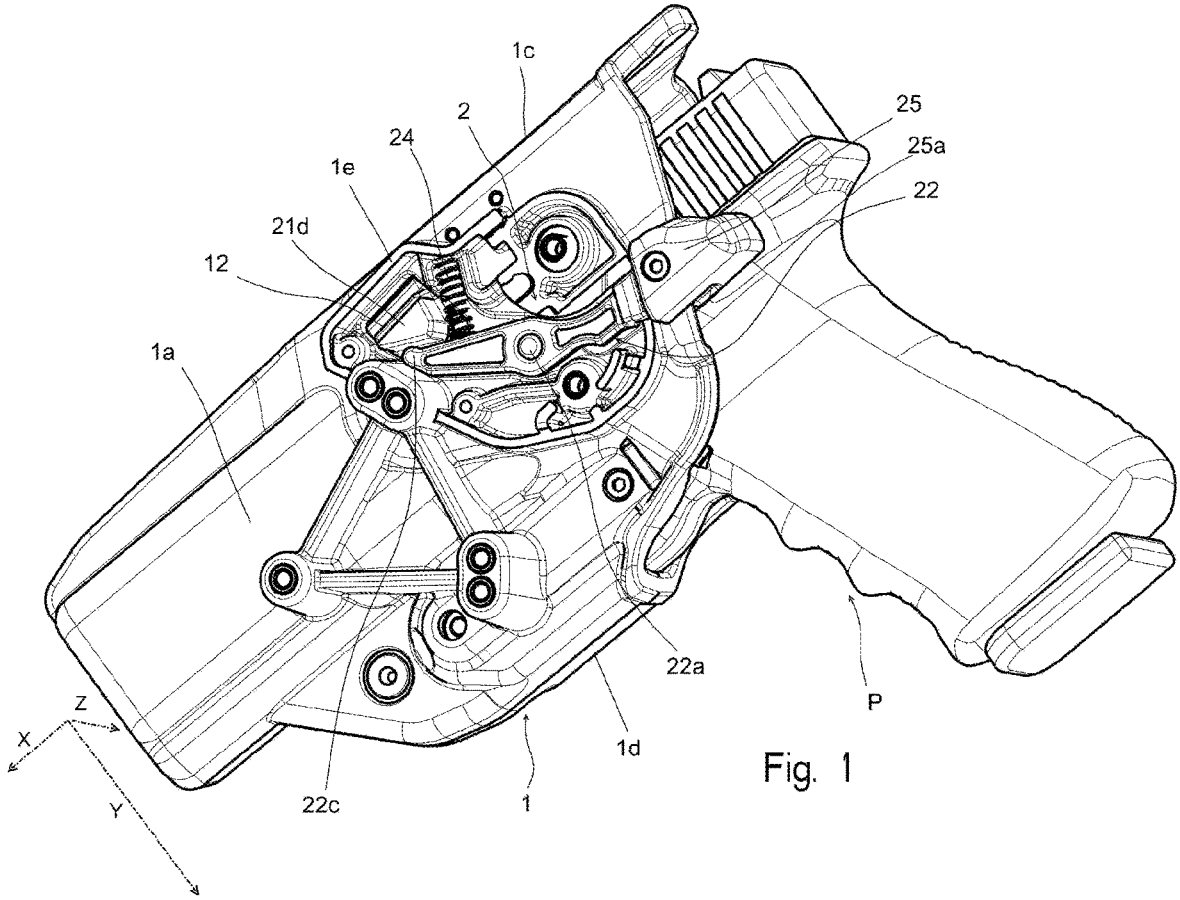
FIG. 1 is a lateral perspective view of a holster according to the present invention, with parts removed for the sake of clarity of illustration and with the related handgun inserted.

With referenced to the above figures, a handgun P and a holster are shown, the holster comprising a shell-like body adapted to house the handgun P. For the sake of additional clarity, on the shell 1 there are identified, in relation with the configuration of the weapon it is intended to house, three mutually perpendicular axes/directions to define three Cartesian coordinates; X is the longitudinal direction, according to which the axis of the barrel of the weapon P extends and along which the front region is the region of the muzzle, and the rear region is the region of the grip of the weapon; Y is the direction of the height (the reference is to the shooting orientation with the barrel substantially horizontal, i.e. parallel to the ground on which the user stands), according to which the grip of the handgun and the trigger substantially extend in their elongation and along which the heights of the barrel and of the free end of the grip define respectively a top and a lower region; Z instead is the thickness, or crosswise, direction, perpendicular to the first two and substantially perpendicular to the sides of the handgun P.

The shell 1 is flattened in the direction of the thickness Z, and defines a cavity 11 for housing the weapon extending along the direction X between an end that delimits the handgun insertion opening of the cavity and a bottom end, which in turn is open or blind. Thus, the shell 1 comprises two longitudinal side walls 1*a*, 1*b* mutually opposite in the direction of the thickness and two other longitudinal walls 1*c*, 1*d* mutually opposite in the direction of height, the latter being in practice the walls that correspond to the narrow sides of the handgun, and thus designed to face respectively, when the handgun is inserted, respectively the top ridge of the barrel and the lower part of the trigger guard. Every other feature and component not expressly described is in accordance with the prior art. It should also be mentioned that the handgun P conventionally has a spent casing ejection port recess P1 that opens on the top ridge of the weapon and/or sideways.

The holster according to the invention further comprises a device for locking the weapon against extraction, generically indicated with the numeral 2 and intended to engage in the ejection port P1. Namely, the device according to the invention comprises an element 21 which is pivotally movable around a crosswise axis to engage or disengage the ejection port, so as to exercise the locking action, and a release lever 22 that, actuated by the thumb of the hand of the user, drives the pivotally movable element 21 away from a position of engagement with the weapon and to a position of disengagement from the same weapon.

Figure 2:
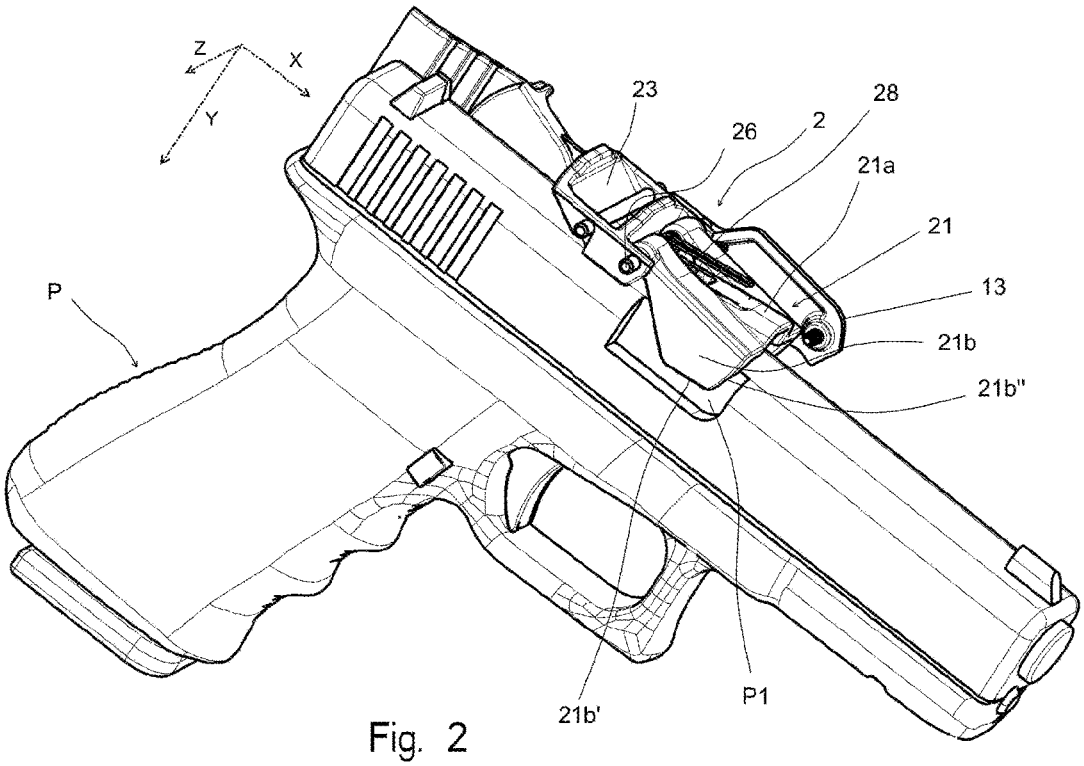
FIG. 2 is a perspective view from the opposite side with respect to that of FIG. 1, again showing the handgun, and with the holster almost completely removed for better showing the engagement system of the locking device according to the invention with the weapon.
Figure 3:
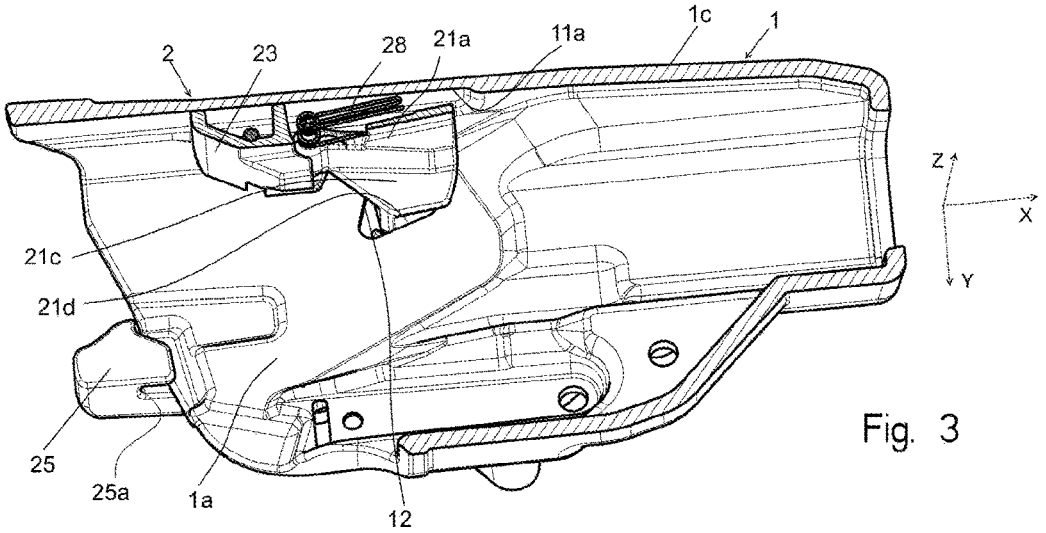
FIG. 3 is an additional perspective view of the holster, without the handgun, and broken away according to a plane of symmetry passing through the longitudinal axis of the holster.
Figure 3A:
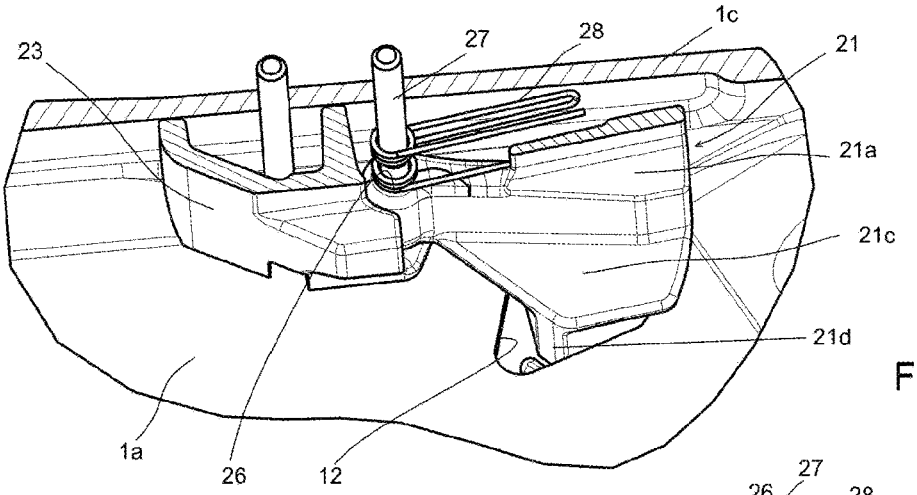
FIG. 3*a* is an enlargement of FIG. 3, in the region of the engagement system, or handgun locking element.
Figure 4:
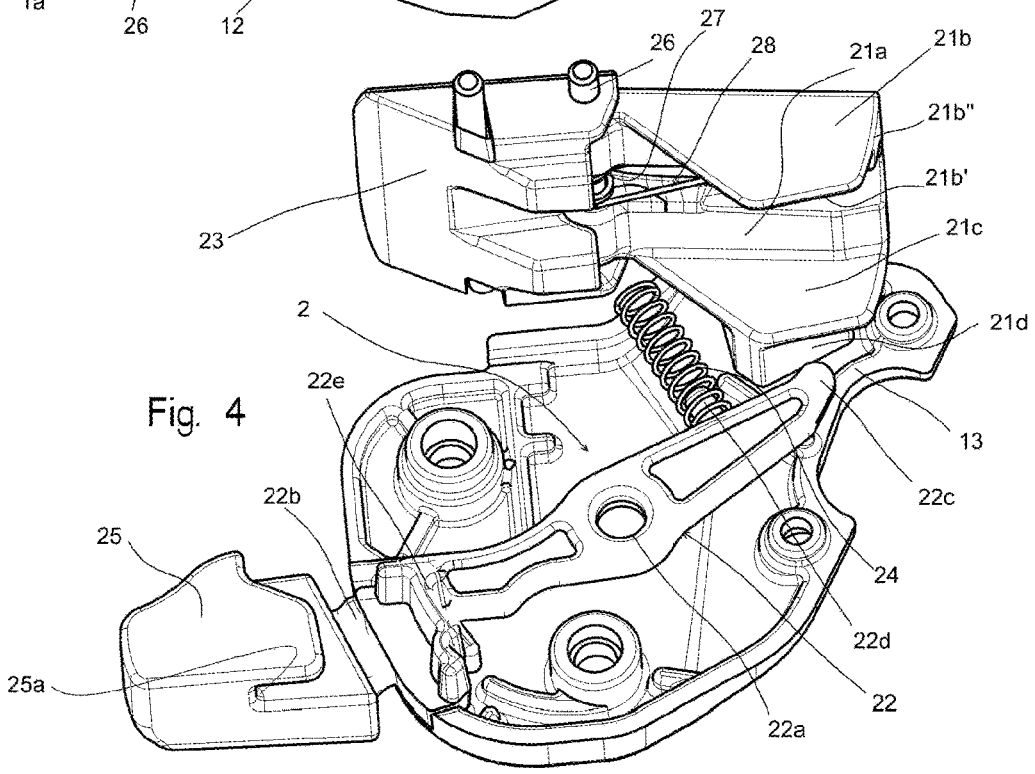
FIG. 4 is yet an additional perspective view of the locking device, isolated from the holster but with the partial representation of a protective cover that closes part of the device between it and the outer surface of the actual shell of the holster.

In greater detail, the locking element 21 is typically but not necessarily a substantially U-shaped member, with a plate-like bridging portion 21*a* resting on the inner face of the top wall 1*c*. Along a rear side of the bridging portion 21*a* a crosswise seat 27 is formed, for pivoting engagement with a pin 26 (shown in FIG. 2) the ends of which are locked to the shell, at the level of the side walls. The pin 26 also acts as a fixing member for fixing a wedge-shaped insert 23 to the shell, immediately upstream of the element 21 (the reference is to the movement of introduction of the weapon along the direction X), with guiding and shielding function, preventing the front end of the barrel of the weapon (the muzzle end) and/or the slide thereof from hitting the flaps of the element 21 and interfere therewith when the weapon is inserted in the shell 1. The insert 23 can clearly be omitted, in which case the bridging portion 21*a* of the locking element 21 can be shaped with a region of its inner surface shaped as a wedge or a lead cavity upstream of the pin, or replaced by a filler of the holster body, which can also be removable, with similar functions.

First elastic means, such as a torsion spring 28, are further provided around the pin 26 and stressed between the bridging portion 21*a* of the locking element 21 and the top wall 1*c* of the shell. The spring 28 opposes the rotational motion of the locking element 21 from a position of engagement with the ejection port (i.e. a lowered position towards the weapon) to a disengagement position (raised, to reach closer to the top wall), while on the contrary a natural positioning of the element in the engagement/locking position is driven by the spring in the absence of external actuation.

From the two sides of the plate-like bridging portion 21*a* two flaps 21*b*, 21*c* project downwards, at least a first one (21*b*) of which is shaped to be inserted, in the lowered or locking position in the ejection port P1 of the handgun, when the handgun is inserted in the holster. An edge of said first flap is shaped with a slanting rear segment 21*b*' (with respect to the axes X-Y), to promote lifting of the element 21 as a result of the abutment of the handgun entering the holster; the handgun insertion can thus cause the locking element to be raised towards the disengagement position, until it elastically snaps when the flap finds the ejection port P1. A front segment 21*b*" of the edge of the flap is instead upright, close to the axis Y, so as to stop the extraction movement of the weapon without generating a lifting force component, that can occur only as a result of the external actuation described below.

The other flap 21*c* provides an outer tooth 21*d* that projects according to the thickness direction Z, towards the outside of the shell, through the related side wall 1*a* thanks to a fracture 12 formed in the same wall. According to the present embodiment, the aforementioned release lever 22 is arranged on the outside of this side wall 1*a*, in a gap between the same wall and a protective cover 13. The release lever is a first-class lever, pivoted to the side wall 1*a* at a central hinge point 22*a* with axis of rotation according to the crosswise or thickness direction, and thus substantially orthogonal with the side walls 1*a*, 1 *b*.

The lever 22 thus lies on a plane parallel to the plane XY, with a generally slanting arrangement with respect to the aforementioned axes, at an indicative angle in the range of 30°+60° (taking as a reference an axis that joins the two ends). An actuation end 22*b* is substantially in correspondence to the inlet opening of the cavity 11 (rear side of the shell 1), arranged so as to project longitudinally, in an appreciable manner, beyond the profile of said opening, that is to say beyond the rim of the side wall 1*a* that edges the opening. In an inactive position, the end is well spaced both from the height of the lower wall 1*d* and especially from that of the top wall 1*c*; indicatively, the actuation center of the lever on the actuation end is located at a distance, from the top wall 1*c*, of at least ¼ (one quarter) of the overall height span between the two heights at the inlet opening, and preferably within the middle third (⅓) of said span.

The front end 22*c*, on which the resisting force is transmitted, is in proximity to the top wall 1*c* of the shell, at a position corresponding to the fracture 12 and so as to come into contact with the tooth 21*d* of the locking element 21, to push the latter towards the raised disengagement position. Any possible solutions whereby the lever is housed inside the shell would clearly make the fracture superfluous.

The release lever 22 is thus in turn movable between two positions angularly spaced by a few degrees, i.e.: the aforesaid inactive position, in which the rear, actuation end 22*b* is more raised, and the end 22*c* intended to press on the tooth is lowered so as not to interfere with the same tooth; and an active or release position, in which by lowering the rear end 22*b* with the thumb, the front end 22*c* is raised making it abut and press on a lower face of the tooth 21*d*, to overcome the elastic resistance and causing the locking element to be raised from the locking position to the release position. The lever 22 can advantageously be shaped according to a step 22*e* that displaces it slightly outwards between the hinge and the rear end; in addition to bringing the actuation end in yet more favourable position, the step provides stability and precision coupling with corresponding guide shaping formed in the side wall of the shell and/or the inside of said cover 13.

The rotation of the lever can be as well assisted by elastic means, in particular for example by a second spring 24 that urges the lever towards the inactive position, improving the precision and stability of this position. The spring 24 according to this example is compressed between a relief 1*e* formed to the purpose in an outer face of said side wall 1*a* of the shell 1, and a catch 22*d* provided on the lever, between the hinge 22*a* and the front end 22*c*.

Advantageously, this being allowed and promoted by the relatively clear position the actuation end 22*b* at approximately half the height of the holster, on this latter end there is mounted an actual push-button 25, oversized and anatomically shaped, so as to promote a comfortable and safe actuation outside the shell. Being it a distinct, and hence interchangeable, component of the lever, the push-button can be adapted in shape and dimensions to different types of user and size of the his/her hands. An inner groove 25*a* of the push-button can be engaged slidably with the edge of the corresponding side wall of the shell, so as to offer an additional contribution to stop and guide the movement.

The operating behaviour of the holster is readily apparent from the above description. The insertion of the weapon is allowed by the free lifting rotation of the locking element, which rotation is clearly allowed by an adequate chamber 11*a* left free by the inner conformation of the shell/cavity in that region. Since the free end of the lever 22 acts only in pressure on the locking element 21, the lifting movement thereof is completely independent of the lever 22 that is advantageously maintained stable in the inactive position by its own spring 24.

The snapping of the locking element 21 in the ejection port thus stops the weapon in position. At this point, in order to free the handgun, the user acts with the thumb on the push-button 25, making the lever 22 move from the inactive position to the release position. The pressure of the front end of the lever on the tooth 21*d* of the locking element, with slight mutual sliding because of the rotational motion, drives the locking element 21 towards the release position.

The movement of the hand that actuates the lever, as in general in known system that use the thumb, is instinctive and natural. However, in this case, the position of the actuation end and thus of the push-button significantly spaced apart from the top side of the shell, and the direction of actuation that is well angled (no less than 30° with respect to the height direction according to axis Y), ensure that the action required for the release is particularly direct, safe, well-balanced and continuous with respect to the action of gripping the weapon and to the subsequent extraction motion. Thanks to such position, an interchangeable oversized push-button can be provided, more comfortable to press and easy to reach, which is precluded to known solutions in which the push-button at the end of the lever is in a single piece with the lever itself and has small dimensions.

These results are the effect of the configuration of the device in two distinct parts (one for the actuation of the release, the other one for locking), which—without introducing significant complications—allows not to rely on elastic deformations of the material (the elastic means ensure the return of the lever and of the locking element), which improves operating reliability. The spring that acts on the tilting locking element, and the ample angular excursion thereof, causes it to perform its stop task safely and reliably, without employing supplementary tension regulators, as in the example mentioned in the introductory part.

The device located in the gap between the actual shell and the cover is well protected against intrusions of external agents (sand, mud, etc.) which could compromise its good operation. The lever 22, because of its dimensions, position and relative amplitude of the rotational travel can also be used for the activation and/or deactivation of other auxiliary safety devices, and to this purpose it can be shaped for example with additional protuberances or arms able to determine the transmission of motion to the aforesaid devices or auxiliary elements.

The elements and components visible in the drawings and not expressly mentioned in the present description are related to features of the holster that are extraneous and independent from those of the present invention, and in any case they are connected with constructive aspects to be considered known and traditional in the field.

The present invention has been described so far with reference to preferred embodiments. It should be understood that there may be other embodiments that pertain to the same inventive core, as defined by the scope of protection of the following claims.

The invention claimed is:

1. An improved holster for a gun (P) comprising a spent casings ejection port (P1), the holster comprising:

a hollow shell extending along a longitudinal direction (X) between an end that delimits a handgun inlet opening, and a bottom end, said shell comprising two side walls substantially parallel with said longitudinal direction and mutually joined by a top wall and a lower wall, spaced from each other according to a height direction (Y);

a locking element arranged inside said shell close to said top wall and comprising a first flap shaped to insert in said ejection port (P1) of the handgun, pivotally supported by the shell around a crosswise rotation axis between an engagement position in which said first flaps engages with said ejection port (P1) to lock the handgun inside the shell, and a disengagement position lifted towards said top wall in which said first flap does not interfere with the extraction movement of the handgun;

first elastic means adapted to promote the rotation of said locking element from said disengagement position to said engagement position;

a release lever configured as a first-class lever and in turn pivotally supported by one of said side walls around a rotation axis arranged in a crosswise direction (Z) which is substantially perpendicular to said side walls, providing a rear actuation end for actuation by the user, and a front end adapted to engage with said locking element, the release lever being pivotally movable between an inactive position, in which said front end does not interfere with said locking element and a release position in which said front end pushes said locking element to said disengagement position;

wherein said release lever is configured such that said rear end projects in said longitudinal direction (X) beyond an end rim of the relative side wall that edges said inlet opening of the shell, and such that the same rear end is spaced in said inactive position both from said top wall and said lower wall, and wherein said release lever has a generally slanting arrangement, at an angle in the range of 30°-60° with respect to said longitudinal direction (X).

2. The holster according to claim 1, wherein an actuation center of said lever in said rear end is located at a distance, from said top wall, of a quarter of the overall height span between the same top wall and said lower wall, measured at the level of inlet opening, and optionally within the middle third of said height span.

3. The holster according to claim 1, comprising second elastic means adapted to urge the rotation of said release lever from said release position towards said inactive position.

4. The holster according to claim 1, wherein said locking element provides a tooth that protrudes crosswise, said front end of the release lever being adapted to press said tooth to promote the rotation of said locking element towards said disengagement position.

5. The holster according to claim 4, wherein said release lever is arranged on the outside of one of said side walls, said tooth protruding outside of said shell through a fracture formed in the same side wall.

6. The holster according to claim 5, wherein said release lever is housed in a gap defined between one of said side walls and a protective cover.

7. The holster according to claim 6, wherein said release lever develops by forming a step that displaces said rear end with respect to rotation plane and that is coupled with corresponding guide shaping formed in the side wall of the shell and/or the inside of said cover.

8. The holster according to claim 4, wherein said second elastic means comprise a spring compressed between a relief formed on an outer face of said side wall, and a catch provided on the lever, between the rotation axis and said front end.

9. The holster according to claim 4, wherein said locking element is a substantially U-shaped member, with a plate-like bridging portion arranged close to the inner face of said top wall, said first flap and a second flap carrying said protruding tooth extending downwards from said bridging portion.

10. The holster according to claim 9, wherein an edge of said first flap is shaped with a slanting rear segment, adapted to promote the lifting towards the disengagement position as a result of the abutment from the handgun entering the shell, until an elastic snap when said flap finds the ejection port (P1), and an upright front segment adapted to stop the extraction movement of the handgun without being lifted by such movement in the absence of an actuation of said release lever.

11. The holster according to claim 9, wherein the rotation axis of said locking element is realized through a pin extending between said side walls and pivotally supporting said bridging portion, said first elastic means comprising a torsion spring arranged around said pin and urged between said bridging portion of the locking element and said top wall.

12. The holster according to claim 4, further comprising a leading surface, defined by a wedge-shaped insert fixed against said top wall upstream of said locking element, or by the same locking element upstream of the relative rotation axis, said leading surface being adapted to guide the handgun insertion and to shield at least said first flap from possible impacts from the muzzle or the slide of the same handgun.

13. The holster according to claim 1, wherein an oversized and anatomically shaped push-button is mounted on said rear end.

14. The holster according to claim 13, wherein said button has an inner groove slidably engaged with an edge of a corresponding side wall of the shell.

* * * * *